US005178166A

United States Patent [19]

Newsome et al.

[11] Patent Number: 5,178,166

[45] Date of Patent: Jan. 12, 1993

[54] FILTER CIGARETTE

[75] Inventors: Reginald W. Newsome, Richmond; Alexander S. Gergely, Powhatan; Richard A. Thesing, Richmond; William T. Callaham, Richmond; Paul N. Gauvin, Richmond; Warren E. Claflin, Richmond; Walter A. Nichols, Richmond, all of Va.

[73] Assignee: Philip Morris Incorporated, New York, N.Y.

[21] Appl. No.: 585,813

[22] Filed: Sep. 20, 1990

[51] Int. Cl.[5] ..... A24D 3/04

[52] U.S. Cl. ..... 131/336; 131/84.4; 131/281; 131/342

[58] Field of Search ..... 131/336, 281, 84.4, 131/342

[56] References Cited

U.S. PATENT DOCUMENTS

| | | | |
|---|---|---|---|
| 3,283,762 | 11/1966 | Kissel . | |
| 3,324,862 | 6/1967 | De Simone . | |
| 3,426,761 | 2/1969 | Fernandez . | |
| 3,469,584 | 9/1969 | Doppelt . | |
| 3,490,461 | 1/1970 | Osmalov . | |
| 3,511,247 | 5/1970 | Tamol | 131/336 |
| 3,658,069 | 4/1972 | Wise et al. | 131/342 |
| 3,664,350 | 5/1972 | Wall | 131/336 |
| 3,773,053 | 11/1973 | Stephens, Jr. . | |
| 4,196,740 | 4/1980 | Rudazinat | 131/84.4 |
| 4,256,122 | 3/1981 | Johnson | 131/336 |
| 4,338,956 | 7/1982 | Sanford et al. . | |
| 4,362,171 | 12/1982 | Johnson et al. . | |
| 4,362,172 | 12/1982 | Johnson . | |
| 4,365,641 | 12/1982 | Johnson . | |
| 4,387,728 | 6/1983 | Reynolds et al. . | |
| 4,406,294 | 9/1983 | Lamb . | |
| 4,478,229 | 10/1984 | Luke . | |
| 4,498,488 | 2/1985 | Johnson . | |
| 4,542,754 | 9/1985 | Cantrell et al. . | |
| 4,545,391 | 10/1985 | Johnson . | |
| 4,569,359 | 2/1986 | Nowers et al. | 131/281 |
| 4,583,560 | 4/1986 | Sakai et al. . | |
| 4,608,999 | 9/1986 | Johnson . | |
| 4,644,964 | 2/1987 | Duke . | |
| 4,646,762 | 3/1987 | Riehl et al. . | |
| 4,681,125 | 7/1987 | Johnson . | |
| 4,941,485 | 7/1990 | Perfetti et al. | 131/336 |

*Primary Examiner*—V. Millin
*Assistant Examiner*—Lynne A. Reichard

[57] ABSTRACT

A filter cigarette comprising a tobacco rod and filter portion comprising a fluted tubular extrusion. The flutes are blocked intermediate the rod end and mouth end of the extrusion. The tobacco rod is circumferentially wrapped with a porous wrapper comprising a longitudinal band of perforations. The fluted tubular extrusion is attached with tipping paper to the tobacco rod. A mouthband and a rodband of perforations circumscribes the tipping paper. A rod of charcoal-impregnated filter material may abut the tubular extrusion.

15 Claims, 4 Drawing Sheets

FILTER CIGARETTE

TECHNICAL FIELD OF THE INVENTION

The present invention relates to filter cigarettes. More particularly, the present invention relates to filter cigarettes with novel means for diluting cigarette smoke with outside air.

BACKGROUND OF THE INVENTION

Filter cigarettes with means for diluting the smoke stream with outside air have been constructed in the art. For example, the wrappers surrounding the filter, the tobacco, or both may be made of a porous material that allows outside air to be drawn into the smoke stream, thereby diluting it. Alternatively, either or both of these wrappers may be perforated. It is also known to provide grooves or flutes in the filter or in a filter mouthpiece that direct dilution air to the smoker's mouth.

In one configuration, shown in U.S. Pat. No. 3,490,461, a fluted plastic mouthpiece is provided, wherein the dilution air enters perforations in the tipping paper and flows down the flutes to the smoker's mouth. In this configuration, the dilution air first mixes with the smoke in the smoker's mouth. Another structure is shown in U.S. Pat. No. 4,256,122, in which the dilution air flows through grooves embedded in a filter previously wrapped in a nonporous wrapper.

A problem with structures including perforations in flow communication with flutes or grooves that deliver dilution air directly to the smoker's mouth without first mixing with the tobacco smoke stream is that the perforations may become occluded or blocked by the smoker during actual smoking. In this case, the amount of dilution air in each puff is reduced or eliminated, thus increasing the amounts of tar and nicotine delivered to the smoker in each puff. This problem may be alleviated by the use of a secondary source of dilution air. The secondary source is provided so that the dilution air flows through channels that cannot be occluded by the smoker in addition to flowing through the primary dilution grooves. U.S. Pat. No. 4,256,122 shows a filter configuration that has two sets of channels.

The foregoing known dilution means is effective to direct through one set of channels dilution air to the smoker's mouth while directing through the other set of channels dilution air into the tobacco column filter interface and back to the smoker's mouth but provides over-dilution of the smoke delivered to the smoker's mouth in many instances. For example, air admitted through perforations chosen to provide a specified dilution in the event primary dilution channels are completely occluded will cause over-dilution when such perforations are not occluded or are only partially occluded. Also, when this dilution means is employed with discrete rows of perforations experience has shown that the size of such perforations required for desirable values of secondary dilution leads to undesirable smoke blow-back through these perforations.

Accordingly, a filter cigarette that incorporates both primary and secondary dilution channels while simultaneously minimizing over-dilution and smoke blow-back is desired.

SUMMARY OF THE INVENTION

The present invention solves the problem referred to above by providing a filter cigarette which comprises a substantially cylindrical tobacco rod wrapped in cigarette paper that has been selectively perforated and a filter extrusion wrapped with tipping paper that has also been selectively perforated in two areas, a mouthband and a rodband, to increase the amount of outside air drawn into the smoke stream when the cigarette is smoked. The perforations in the mouthband allow outside air to flow through the perforations, into the channels, and into the smoker's mouth; this provides primary dilution air. The perforations in the rod band allow outside air to flow through the perforations, into the channels, up to the tobacco rod, down through filter material in the central tube of the filter extrusion, and into the smoker's mouth. This construction provides means for introducing secondary dilution air. According to this invention, it is possible to select the size, amount and techniques of forming the two bands of perforations as well as the perforations in the cigarette paper wrapping the tobacco rod, thereby producing overall dilution at optimal levels.

The filter comprises a fluted tubular thermoplastic extrusion that is impervious to both smoke and air. The hollow central tubular portion of the filter extrusion may be filled with a filter material such as cellulose acetate tow. The tipping paper wrapping the filter extrusion is impervious to smoke and air. This paper also serves as a means for attaching the filter to the wrapped tobacco rod.

The flutes of the filter extrusion, in cooperation with the tipping paper, comprise channels through which dilution air may flow. These channels are permanently blocked intermediate the two ends of the filter. The blockage in the channels prevents both smoke and secondary dilution air from entering the primary dilution channels. The tipping paper is perforated in two separate bands.

DETAILED DESCRIPTION OF THE INVENTION

The invention will now be described with reference to the Figures, in which like elements are given like reference numbers throughout.

Figure 1:
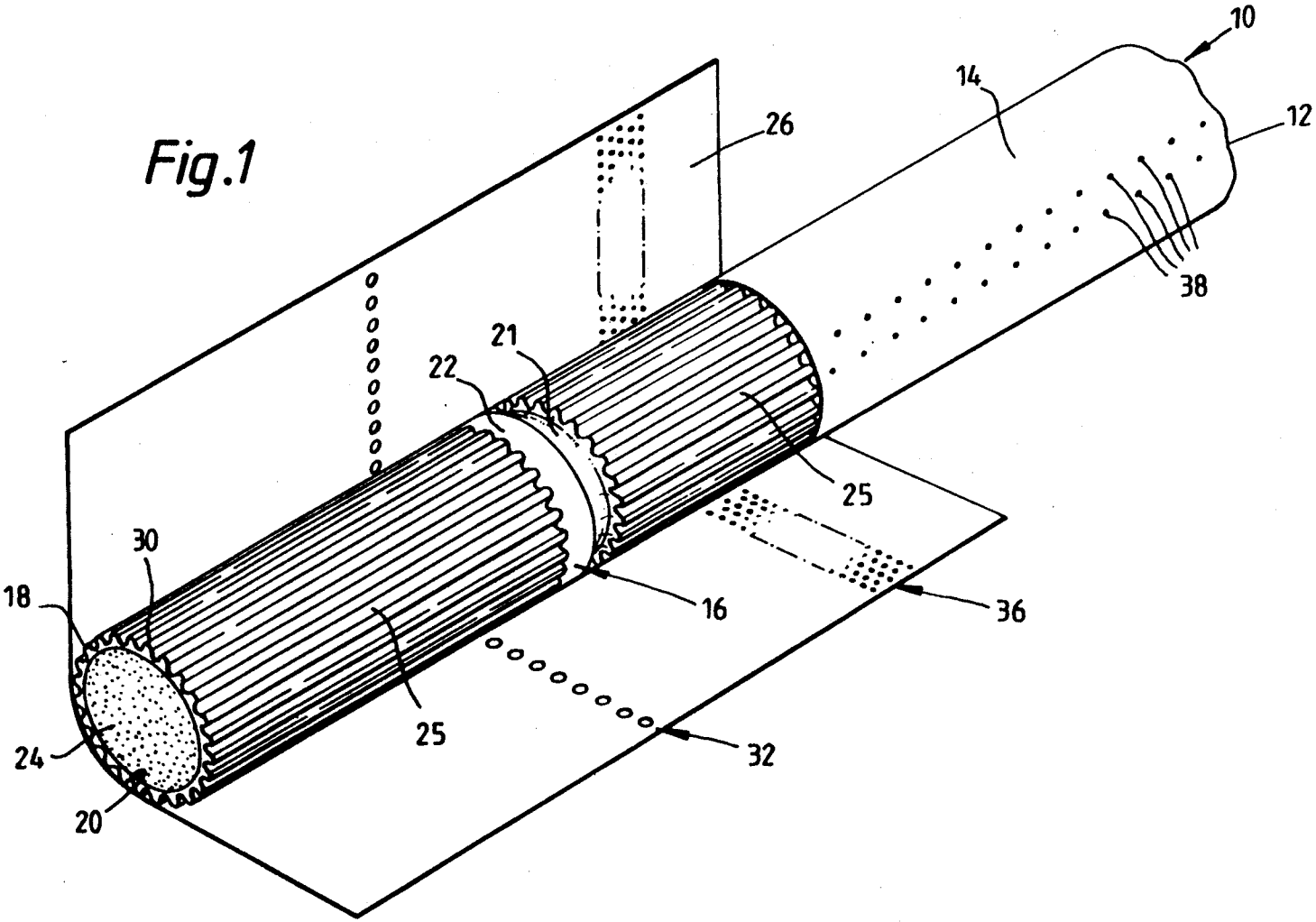
FIG. 1 is a perspective view of a first preferred embodiment of the filter cigarette of the present invention shown in a partially unwrapped condition.
Figure 2:
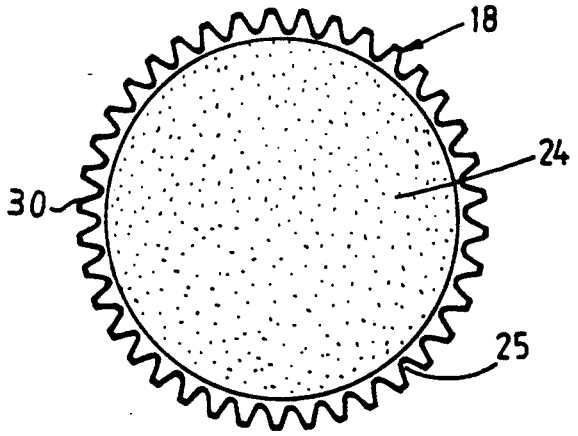
FIG. 2 is an end view of the unwrapped filter portion of a cigarette according to the present invention looking from the mouth end of the cigarette.
Figure 3:
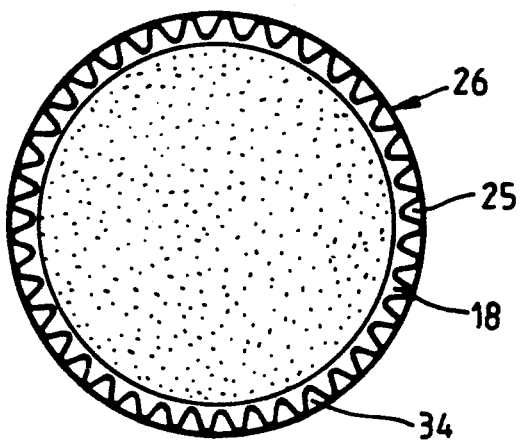
FIG. 3 is a view similar to FIG. 2, except it shows the tipping material wrapped around the filter portion.

A preferred embodiment of the filter cigarette 10 of the present invention is shown in FIGS. 1–3, and comprises a filter portion 16 and a substantially cylindrical tobacco rod 12 wrapped in cigarette paper 14. The cigarette paper may preferably be a 12-second increased citrate cigarette paper such as Kimberly Clark paper number 611 from Kimberly Clark Co., or Ecusta paper number 511 from Ecusta Co., or a normal citrate cigarette paper such as Kimberly Clark paper number 110-6 or Ecusta paper number 751.

The filter portion 16 comprises a fluted tubular extrusion 18, preferably of polyethylene, that is impervious to both smoke and air. The tubular extrusion is axially aligned with and joined in abutting, end-to-end relationship with the wrapped tobacco rod. In a preferred embodiment, the extrusion is 27 mm long. The hollow central tube portion 20 of the extrusion is filled with a filter material 24, such as cellulose acetate tow.

In a preferred embodiment of the present invention, the extrusion comprises a plurality of closed flutes 25 extending longitudinally a distance from the tobacco rod end of the tubular extrusion 18 to a circumferential blocking means 22 and extending longitudinally a distance from the mouth end of the extrusion 18 to the circumferential blocking means 22.

The blocking means 22 may be prepared according to the preferred embodiment of this invention by embedding an annular groove 21 around the fluted filter extrusion, then subjecting the filter to a sizing means designed to produce a circumferentially extended plateau contiguous to the groove and extending toward the mouth end.

To this end, the groove preferably may be formed by applying directly to the filter extrusion a heated plow device which raises and transfers material into adjacent open flutes. The groove is formed at a depth no deeper than the thickness of the extrusion 18. The groove is positioned on the filter portion in such a manner that it will be located approximately midway between the ends of the filter portion, i.e., approximately 13 or 14 mm from the edge of the filter portion furthest from the tobacco rod. The next operation is to subject the material to a heated iron in order to form a circumferentially extended plateau. Preferably, the width of the plateau is in the range of about 1.5 to 2.0 mm. Blockage serves to prevent primary dilution air from entering the tobacco rod and prevents secondary dilution air and smoke from the 5 tobacco rod from flowing through the channels directly to the smoker's mouth.

Figure 4:
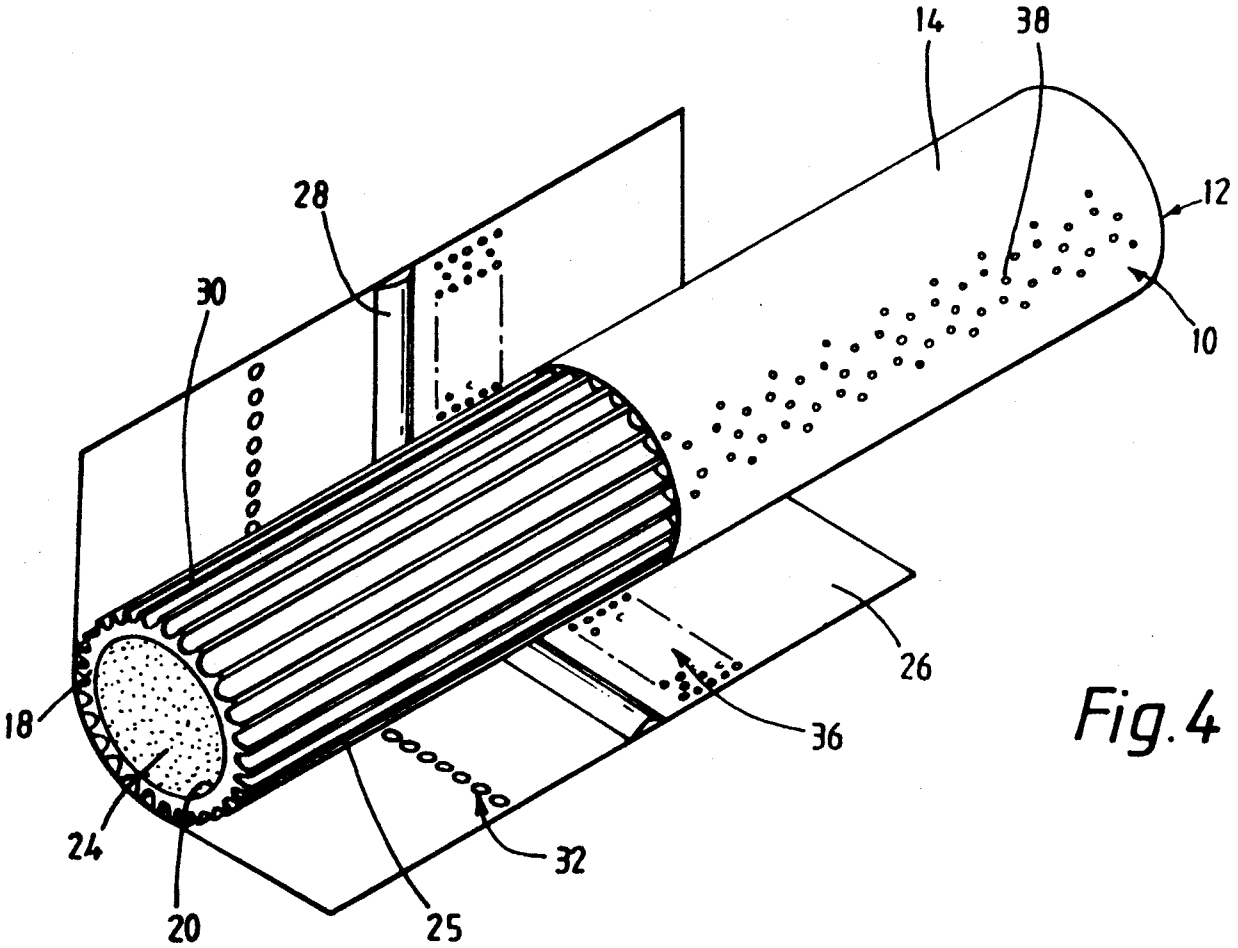
FIG. 4 is a perspective view similar to FIG. 1, showing a partially unwrapped second preferred embodiment of the filter cigarette of the present invention.

An alternative method of obtaining a blocking means is by using a precoated tipping paper containing a bead of hotmelt adhesive 28, which is wrapped circumferentially around the filter extrusion as shown in FIG. 4. A bead of hotmelt adhesive such as, for example Eastobond A-435, from Eastman Chemical Products, Inc., Kingsport, Tenn. is applied to tipping paper before it is wrapped around the filter portion and the wrapped tobacco rod.

Still further, according to the present invention an alternative method of filling the flutes in the filter extrusion is by the use of foamed hotmelt adhesive applied as a bead to the tipping paper. Foamed hotmelt may be produced by use of a Nordson model 150B system. In this unit, hotmelt is melted and mixed with a gas, e.g., nitrogen or carbon dioxide. As the material is discharged from the nozzle, the gas expands and creates a low density (less than about 0.7 gm/cc) foam. An advantage of foamed hotmelt is that it reduces the amount of hotmelt needed. Additionally, foamed hotmelt has viscosity properties that permit the use of hotmelt adhesives that would be too viscous for proper application in the unfoamed state.

Whatever blocking means is employed, tipping paper is wrapped around the filter portion and the wrapped tobacco rod. The tipping paper 26 preferably is 4–5 mm longer than the length of the filter. This length allows a sufficiently wide portion of the tipping paper to overlay the wrapped tobacco rod, thus serving to attach the filter portion to the wrapped tobacco rod.

Because the conventional polyvinyl acetate adhesives commonly used for cigarette tipping papers will not adhere to the polyethylene extrusion, the tipping paper is precoated with a non-toxic EVA-copolymer based hotmelt adhesive. In a preferred embodiment, Ecusta Number 3 hotmelt adhesive is applied at a rate of 20±2 grams/square meter as a precoating on standard cigarette tipping paper. The tipping paper preferably is selected so that after coating, the tipping paper is impervious to both smoke and air.

If a hotmelt bead is employed as a blocking means, the hotmelt bead is applied to the precoated inner surface of the tipping paper. This arrangement forces the hotmelt bead into the flutes of the filter extrusion when the tipping paper is wrapped around the filter portion. The bead is applied to the tipping paper such that the bead will be located a distance similar to that described above for the plateau.

The bead may be applied to the precoated tipping paper using a hotmelt system such as the Nordson Corp., Model 6000. The adhesive is melted in the system and pumped to a nozzle with a 0.008 inch orifice, using a hydraulic pressure of 300–400 psig. The nozzle is equipped with a solenoid operated valve, capable of high speed oscillation for patterned application. By appropriate timing of the valve, a 27 mm pattern, i.e., a 25 mm hotmelt bead followed by 2 mm of no bead, can repeatedly be applied to the tipping paper. Patterned application is desirable to prevent bleed-out of hotmelt on the 2 mm lapseam that results when the tipping paper is wrapped around the filter portion and the wrapped tobacco rod. Patterned application of the hotmelt bead also assists machining, as the knives that sever the tipping paper into 27 mm wide sections may thus sever the tipping paper at a position having no hotmelt bead.

A similar method of applying foamed hotmelt may be used. Before the tipping paper is wrapped around the combination of the filter portion and the wrapped tobacco rod, the tipping paper is heated to reactivate the precoated hotmelt adhesive and rolled over the combination of the filter portion butted against the wrapped tobacco rod. The precoated tipping paper bonds to the peaks 30 of the flutes of the plastic extrusion, causing the tipping paper to cooperate with the flutes to form smoke- and air-impervious channels that extend the length of the filter element. If a bead of hotmelt or foamed hotmelt is used as a blocking means during the rolling action, the bead is compressed into the flutes of the plastic extrusion so as to bond the tipping paper tightly to the periphery of the plastic extrusion and substantially fill the void of the flutes. Thus each channel is separated into two separate portions: one open to and in fluid communication with the tobacco rod, and the other open to and in fluid communication with the smoker's mouth when the cigarette is smoked.

Several parameters must be controlled for successful processing of the filter cigarette of the present invention. The hotmelt used for precoating the tipping paper must be selected so that the reactivation temperature and time will not cause melting of the plastic extrusion. The viscosity of the hotmelt used for the bead 28 must be below 1500 centipoise at 350° F. Higher viscosity hotmelts may not permit oscillation of the solenoid, and thus will produce poor pattern definition. The size of the nozzle used for application of the hotmelt bead and the hydraulic pressure in the hotmelt system control the quantity of hotmelt dispensed. If this quantity is insufficient, the cross sectional area of the flutes is not filled and improper filter performance results.

During smoking of the filter cigarette of the present invention, dilution air is introduced through several means. Primary dilution air enters through a band of perforations 32 in the tipping paper 26 located intermediate the blocking means 22 or 28 and the mouth end of the filter element. In a preferred embodiment, these perforations are located between 12 mm and 14 mm from the mouth end of the filter element, forming a 2 mm wide band. The perforations are formed with a laser perforator. The size and distribution of these perforations are selected to achieve approximately 80% dilution.

When the filter cigarette of the present invention is smoked, primary dilution air enters through the perforations 32, travels through the channels 34 formed by the flutes and the tipping paper, and enters the smoker's mouth.

Secondary dilution air enters through a second band of perforations 36 in the tipping paper. As shown in FIG. 1, this secondary dilution band is located intermediate the tobacco rod and the blocking means. In a preferred embodiment, the secondary dilution perforations form a band approximately 4.0–5.0 mm wide commencing at approximately 22 mm from the mouth end of the filter. Unlike the primary dilution perforations, the secondary dilution perforations are preferably formed by techniques known in the art as, for example, electrostatic perforation or electric spark perforation (ESP). In comparison to the laser perforation technique used for the primary dilution perforations, ESP produces a larger number of smaller perforations, distributed in a random pattern within the perforation area, for any particular dilution factor. The use of ESP allows the secondary dilution factor to be sufficiently high to achieve the desired total dilution effect while minimizing the undesirable smoke blow-back that is typically present when laser perforation is used to achieve the same dilution. In a preferred embodiment, ESP is used to achieve secondary dilution of about 16±2%.

When a filter cigarette according to the present invention is smoked, the pressure drop caused by the flow of smoke through the tobacco rod and through the central portion of the filter extrusion causes the air to enter the secondary dilution perforations, flow through the channels formed by the flutes of the filter extrusion cooperating with the tipping paper toward the tobacco rod. This secondary dilution air mixes with the smoke stream and is drawn through the filter material 24 into the smoker's mouth.

If, during smoking, the flow of primary dilution air is diminished, as for example, by blockage of the flutes by lip occlusion, the pressure drop through the filter material 24 increases. This causes the flow of secondary dilution air to increase, thus limiting the decrease in dilution. By appropriately selecting the primary and secondary dilution amounts, the minimum and maximum total effective dilution can be adjusted to desired values.

As noted above, however, if the secondary dilution is made porous enough to achieve a desired minimum dilution when the primary dilution air is completely blocked, the smoker may perceive the cigarette as too "airy," or over-diluted, when the primary dilution air is not blocked. Prior to the present invention, cigarette designers have been unable to achieve a balance between a desired minimum dilution and undesirable over-dilution. As shown in FIG. 1, the filter cigarette of the present invention solves this problem by adding a longitudinal band 38 of perforations to the cigarette paper 14 of the tobacco rod.

In a preferred embodiment, the standard cigarette paper wrapping the tobacco rod is given 5 to 8 rows of ESP perforations 38 along its length. The amount of perforations preferably should achieve a porosity for the cigarette paper of about 130±10 Coresta (CU). As in the case of the secondary dilution perforations in the filter tipping paper, the use of ESP rather than laser perforation minimizes the amount of smoke blow-back through the tobacco rod dilution perforations.

During smoking, additional dilution air enters the tobacco rod through the perforations 38 in its wrapper. This additional dilution air mixes with the smoke stream and the secondary dilution air discussed above, and is then drawn into the smoker's mouth. It has been found that the introduction of this additional dilution air permits the secondary dilution factor to be reduced, thus minimizing the "airy" sensation when the primary dilution air is blocked. This air also reduces smoke blow-back through the secondary dilution perforation, while at the same time preventing the total dilution from dropping below a minimum desired value.

ISO smoking tests of cigarettes according to the present invention gave the amounts of Tar, Total Particulate Matter (TPM), Nicotine, Water, and Puff count (PC) which are shown in Table 1. In Table 1, N4 and N5 refer to two different cigarette models, respectively. "Open" and "Occluded" refer to whether the primary dilution channels are completely open or completely occluded, respectively.

TABLE 1

| | N4 (Open) | N4 (Occluded) | N5 (Open) | N5 (Occluded) |
|---|---|---|---|---|
| Tar | 1.8 | 10.9 | 2.2 | 11.3 |
| TPM | 2.1 | 14.0 | 2.5 | 14.7 |
| Nic. | 0.18 | 0.78 | 0.23 | 0.81 |
| Water | 0.10 | 2.32 | 0.15 | 2.50 |
| PC | 8.2 | 6.2 | 7.8 | 6.4 |

It has been observed that a typical smoker will receive the average of the open and occluded values, e.g., for N4, the smoker would receive approximately the average of the open and occluded values $(1.8+10.9)/2=6.4$ mg tar.

Figure 5:
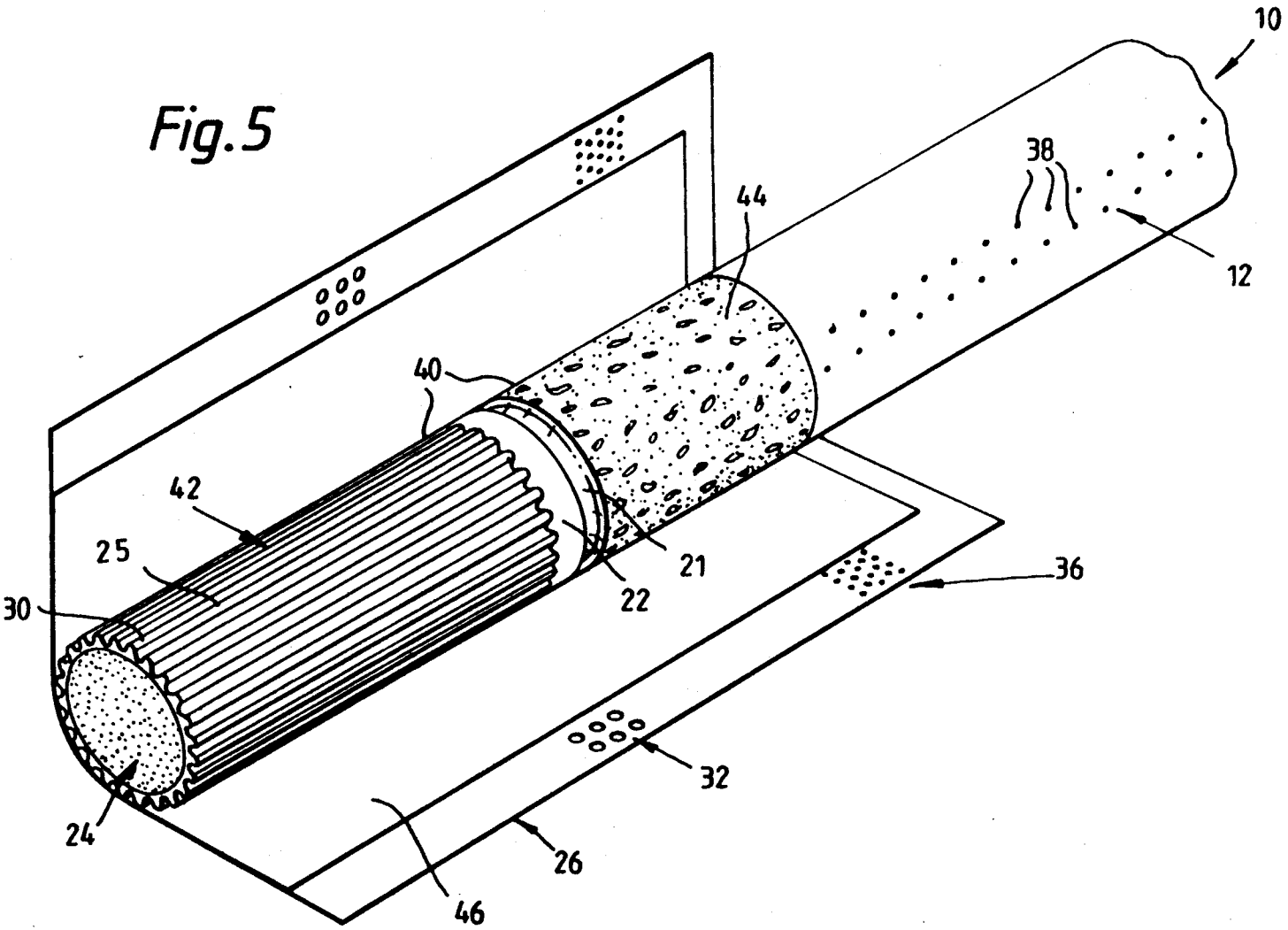
FIG. 5 is a perspective view similar to FIG. 1, showing a partially unwrapped filter cigarette of the present invention including a charcoal filter section.

In another embodiment of the present invention, as shown in FIG. 5, the filter portion 40 includes a rod of charcoal-impregnated filter material. A cellulose acetate/charcoal rod 44 may be positioned between a fluted tubular extrusion 42 and the tobacco rod 12. Extrusion 42 is, like extrusion 18, formed of a thermoplastic material, preferably polyethylene, that is impervious to smoke and air; it is filled with cellulose acetate tow filter material. Extrusion 42 is identical to extrusion 18 except that extrusion 42 typically is shorter. In a preferred embodiment, extrusion 42 is 18 mm long and cellulose acetate/charcoal rod 44 is 9 mm long, thus making the combined length of the filter portion 40 of this embodiment of the invention 27 mm, the same as the length of filter portion 16 in the previously described embodiment of the present invention.

The combination of extrusion 42 and cellulose acetate/charcoal rod 44 is wrapped with precoated tipping paper 26 as in the previously-described embodiments.

The precoated tipping paper is impervious to both smoke and air. At the rod end of extrusion 42, the channels 34 formed by the cooperation of the flutes and the tipping paper are initially in flow communication with the cellulose acetate/charcoal rod.

For ease in handling in subsequent manufacturing steps, cellulose acetate/charcoal rod 44 typically is combined with an extrusion 42 using a combining wrap 46.

According to the preferred embodiment of this invention, the blocking means may be prepared by embedding an annular groove 21 around the fluted filter extrusion adjacent to or at a distance from the cellulose acetate/charcoal rod, then producing a circumferentially extended plateau in accordance with the procedure described above for the preferred embodiment excluding the rod.

Alternatively, when the blocking means is formed from a bead of hotmelt, slitting knives may be used to cut through the combining wrap, creating a slit located over the extrusion, not over the cellulose acetate/charcoal rod. A bead of hotmelt is applied to the tipping paper such that when the tipping paper is wrapped around the combination of the extrusion, the cellulose acetate/charcoal rod, and the wrapped tobacco rod, the bead is located above the slit in the combining wrap. As the tipping paper is wrapped around the combination, the bead of hotmelt flows through the slit and into the flutes of the extrusion, effectively blocking the channels 34 formed by the cooperation of the flutes and the tipping paper.

Primary and secondary dilution bands 32 and 36 are perforated in the tipping paper as described previously. As in the previously-described preferred embodiment, the primary dilution perforations are located intermediate the blocking means and the mouth end of extrusion 42, and the secondary dilution perforations are located such that the blocking means is between the secondary perforations and the mouth end of the extrusion. This arrangement prevents primary dilution air from flowing into the cellulose acetate/charcoal rod, and likewise prevents smoke and secondary dilution air from flowing directly through the channels to the smoker. Primary dilution air flows only through the primary dilution perforations, into the channels formed by the flutes and the tipping paper, and into the smoker's mouth.

It is not necessary for the secondary dilution perforations to be located over extrusion 42, and typically the secondary dilution perforations are located over the cellulose acetate/charcoal rod. Secondary dilution air thus flows through the secondary ESP perforations into the channels in the extrusion and then into the cellulose-/acetate rod, or typically, directly into the cellulose acetate/charcoal rod. There it mixes with the smoke stream and flows through the filter material in the center of the fluted extrusion, and then into the smoker's mouth.

It will be observed that various changes may be made to the specific embodiments shown and described without departing from the principles of the present invention.

What is claimed is:

1. A filter cigarette comprising:

a filter portion;

a tobacco rod;

said filter portion further comprising a tubular portion having a central passage, said tubular portion being formed of a material substantially impervious to smoke and air;

a plurality of longitudinal flutes defined in the outer surface of said tubular portion and circumferentially spaced therearound;

a smoke-and air-impervious tipping material extending longitudinally along and circumscribing said tubular portion;

said tipping material cooperating with said flutes to define smoke-and air-impervious channels open at a mouth end and open at a rod end of said tubular portion to permit the passage of smoke and air;

blocking means circumferentially positioned on the outer surface of the tubular portion a distance between said mouth end and said rod end effective to block primary dilution air from entering the tobacco rod and to block secondary dilution air and smoke from the tobacco rod from flowing through the channels directly to a smoker's mouth;

a first band of perforations, having a first selected porosity, in said tipping material located intermediate said blocking means and said mouth end to ventilate air therethrough into said channels towards said mouth end, and a second band of perforations, having a second selected porosity, in said tipping material located intermediate said blocking means and said rod end of said tubular portion to ventilate air therethrough into said channels toward said rod end;

said tobacco rod being circumferentially wrapped with a porous wrapper, said porous wrapper having a longitudinal band of perforations to ventilate air therethrough into said tobacco rod;

said filter portion and said tobacco rod being axially aligned in abutting end-to-end relation, said tipping material circumscribing a portion of said tobacco rod exterior of said porous wrapper, whereby said filter material and said channels open at said rod end of said tubular portion are in flow communication with said tobacco rod;

wherein the porosity of said first band of perforations is selected to achieve a greater amount of dilution than the porosity of said second band of perforations.

2. The cigarette according to claim 1 wherein said tipping material is precoated with an adhesive coating.

3. The cigarette according to claim 2 wherein said adhesive is a hotmelt adhesive.

4. The cigarette according to claim 1, wherein the blocking means is selected from the group consisting of a circumferentially extended plateau and a bead of hotmelt adhesive.

5. The cigarette according to claim 1 wherein the perforations in said first band of perforations are formed by means of a laser.

6. The cigarette according to claim 1 wherein the perforations in said second band of perforations are formed by electrostatic perforation means.

7. The cigarette of claim 1 wherein the perforations in said longitudinal band of perforations are formed by electrostatic perforation means.

8. A filter cigarette comprising:

a filter portion;

a tobacco rod;

said filter portion further comprising a tubular portion having a central passage substantially filled with a porous filter material, said tubular portion being formed of a material substantially impervious to smoke and air;

a plurality of longitudinal flutes defined in the outer surface of said tubular portion and circumferentially spaced therearound;

a smoke-and air-impervious tipping material extending longitudinally along and circumscribing said tubular portion;

said tipping material cooperating with said flutes to define smoke-and air-impervious channels open at a mouth end and open at a rod end of said tubular portion to permit the passage of smoke and air;

blocking means circumferentially positioned on the outer surface of the tubular portion a distance between said mouth end and said rod end effective to block primary dilution air from entering the tobacco rod and to block secondary dilution air and smoke from the tobacco rod from flowing through the channels directly to a smoker's mouth;

a first band of perforations in said tipping material located intermediate said blocking means and said mouth end to ventilate air therethrough into said channels towards said mouth end, and a second band of perforations in said tipping material located intermediate said blocking means and said rod end of said tubular portion to ventilate air therethrough into said channels toward said rod end;

said tobacco rod being circumferentially wrapped with a porous wrapper, said porous wrapper having a longitudinal band of perforations to ventilate air therethrough into said tobacco rod;

said filter portion and said tobacco rod being axially aligned in abutting end-to-end relation, said tipping material circumscribing a portion of said tobacco rod exterior of said porous wrapper, whereby said filter material and said channels open at said rod end of said tubular portion are in flow communication with said tobacco rod;

wherein said tipping material is precoated with a hotmelt adhesive, said blocking means comprises a circumferentially extended plateau, the perforations in said first band of perforations are formed by means of a laser, and the perforations in said second band of perforations and the perforations in said longitudinal band of perforations are formed by electrostatic perforation means.

9. The cigarette of claim 8 wherein the porosity of said first band of perforations is selected to achieve approximately 80% dilution, the porosity of said second band of perforations is selected to achieve approximately 14% dilution, and the porosity of said longitudinal band of perforations is selected to be approximately 130 Coresta.

10. A filter cigarette comprising:

a filter portion;

a tobacco rod;

said filter portion further comprising a tubular portion having a central passage substantially filled with a porous filter material, said tubular portion being formed of a material substantially impervious to smoke and air;

a plurality of longitudinal flutes defined in the outer surface of said tubular portion and circumferentially spaced therearound;

a smoke-and air-impervious tipping material extending longitudinally along and circumscribing said tubular portion;

said tipping material cooperating with said flutes to define smoke-and air-impervious channels open at a mouth end and open at a rod end of said tubular portion to permit the passage of smoke and air;

blocking means circumferentially positioned on the outer surface of the tubular portion a distance between said mouth end and said rod end effective to block primary dilution air from entering the tobacco rod and to block secondary dilution air and smoke from the tobacco rod from flowing through the channels directly to a smoker's mouth;

a first band of perforations in said tipping material located intermediate said blocking means and said mouth end to ventilate air therethrough into said channels towards said mouth end, and a second band of perforations in said tipping material located intermediate said blocking means and said rod end of said tubular portion to ventilate air therethrough into said channels toward said rod end;

said tobacco rod being circumferentially wrapped with a porous wrapper, said porous wrapper having a longitudinal band of perforations to ventilate air therethrough into said tobacco rod;

said filter portion and said tobacco rod being axially aligned in abutting end-to-end relation, said tipping material circumscribing a portion of said tobacco rod exterior of said porous wrapper, whereby said filter material and said channels open at said rod end of said tubular portion are in flow communication with said tobacco rod;

wherein said tipping material is precoated with a hotmelt adhesive, said blocking means comprises a circumferentially extended bead of hotmelt adhesive, the perforations in said first band of perforations are formed by means of a laser, and the perforations in said second band of perforations and the perforations in said longitudinal band of perforations are formed by electrostatic perforation means.

11. A method for producing a filter cigarette having optimal levels of overall dilution which comprises a tobacco rod circumferentially wrapped with a porous wrapper and a filter portion comprising a tubular portion wrapped with tipping paper and having a plurality of longitudinal flutes circumferentially spaced therearound, which are in turn intersected with a blocking means to prevent primary dilution air from entering the tobacco rod and prevent secondary dilution air and smoke from the tobacco rod from flowing through channels defined by said tipping paper and said flutes directly to a smoker's mouth; comprising the steps of providing said tipping material with a band of perforations of a first porosity intermediate the blocking means and the mouth end of the tubular portion, providing said tipping material with a band of perforations of a second porosity intermediate the blocking means and the rod end of the tubular portion, and providing in the porous wrapper a longitudinal band of perforations; wherein said first porosity is selected to achieve a greater amount of dilution than said second porosity.

12. The method according to claim 11, wherein said filter cigarette further comprises a substantially cylindrical rod of charcoal-impregnated filter material axially aligned in abutting end-to-end relationship with said tubular portion.

13. The method according to claim 11, wherein the perforations intermediate the blocking means and the mouth end of the tubular portion are produced by a laser perforator.

14. The method according to claim 11, wherein the perforations intermediate the blocking means and the rod end of the tubular portion are produced by electrostatic perforation.

15. A filter cigarette comprising:

a filter portion;

a tobacco rod;

said filter portion further comprising a tubular portion having a central passage substantially filled with a porous filter material, said tubular portion being formed of a material substantially impervious to smoke and air;

a plurality of longitudinal flutes defined in the outer surface of said tubular portion and circumferentially spaced therearound;

a substantially cylindrical rod of charcoal-impregnated filter material axially aligned in abutting end-to-end relationship with said tubular portion;

a smoke-and air-impervious tipping material extending longitudinally along and circumscribing said tubular portion;

said tipping material cooperating with said flutes to define smoke-and air-impervious channels open at a mouth end and open at a rod end of said tubular portion to permit the passage of smoke and air;

blocking means circumferentially positioned on the outer surface of the tubular portion a distance between said mouth end and said rod end effective to block primary dilution air from entering the tobacco rod and to block secondary dilution air and smoke from the tobacco rod from flowing through the channels directly to the smoker's mouth;

a first band of perforations, having a first selected porosity, in said tipping material located intermediate said blocking means and said mouth end to ventilate air therethrough into said channels towards said mouth end, and a second band of perforations, having a second selected porosity, in said tipping material located intermediate said blocking means and said rod end of said tubular portion to ventilate air therethrough into said channels toward said rod end;

said tobacco rod being circumferentially wrapped with a porous wrapper, said porous wrapper having a longitudinal band of perforations to ventilate air therethrough into said tobacco rod;

said filter portion and said tobacco rod being axially aligned in abutting end-to-end relation, said tipping material circumscribing a portion of said tobacco rod exterior of said porous wrapper, whereby said filter material and said channels open at said rod end of said tubular portion are in flow communication with said tobacco rod;

wherein the porosity of said first band of perforations is selected to achieve a greater amount of dilution than the porosity of said second band of perforations.

* * * * *